United States Patent [19]

Juhlin et al.

[11] Patent Number: 4,921,112

[45] Date of Patent: May 1, 1990

[54] MUG WITH INSERT FOR DISPENSING MEASURED QUANTITY

[76] Inventors: Sven-Eric Juhlin, Grindstugatan 3, S-134 00 Gustavsberg; Hakan Bergkvist, Beckombergavagen 72, S-161 53 Bromma; Astrid Norberg, Mariehemsvagen 119, S-902 36 UMEA; Bengt Winblad, Tussmotevagen 120, S-122 41 Enskede, all of Sweden

[21] Appl. No.: 138,906

[22] PCT Filed: Mar. 31, 1987

[86] PCT No.: PCT/SE87/00164

§ 371 Date: Feb. 22, 1988

§ 102(e) Date: Feb. 22, 1988

[87] PCT Pub. No.: WO87/06457

PCT Pub. Date: Nov. 5, 1987

[30] Foreign Application Priority Data

Apr. 21, 1986 [SE] Sweden ..... 8601829

[51] Int. Cl.[5] ..... A61J 7/00

[52] U.S. Cl. ..... 215/11.4; 215/6; 220/90.2; 222/450; 222/456

[58] Field of Search ..... 215/11.1, 11.4, 11.5, 215/6; 222/456, 416, 71, 442, 450, 453; 220/90.2; 604/77, 78; 251/156, 210; 137/628, 101.31

[56] References Cited

U.S. PATENT DOCUMENTS

| | | | |
|---|---|---|---|
| 252,519 | 1/1882 | Richter et al. | 222/450 |
| 298,778 | 5/1884 | Rogers, Jr. | 222/456 X |
| 467,176 | 1/1892 | Jensen | 215/11.4 |
| 532,630 | 1/1895 | Baird | 222/456 |
| 1,498,491 | 6/1924 | Stinson et al. | 222/456 |
| 2,113,501 | 4/1931 | Baxter | 222/456 |
| 2,148,421 | 2/1939 | Allan | 222/450 X |
| 2,742,168 | 4/1956 | Panetti | 215/11.4 |
| 2,877,917 | 3/1959 | Brooks et al. | 215/11.1 |
| 3,044,650 | 7/1962 | Oltion et al. | 215/11.1 |
| 3,129,859 | 4/1964 | Chappell | 222/456 |
| 4,582,230 | 4/1986 | Vierkotter | 222/453 X |
| 4,600,111 | 7/1986 | Brown | 220/90.2 X |

FOREIGN PATENT DOCUMENTS

| | | | |
|---|---|---|---|
| 26802 | 4/1981 | European Pat. Off. | 215/11.1 |
| 622711 | 6/1927 | France | 215/11.5 |
| 229549 | 2/1925 | United Kingdom | 222/456 |
| 394807 | 7/1933 | United Kingdom | 222/456 |

*Primary Examiner*—Sue A. Weaver

*Attorney, Agent, or Firm*—Pollock, Vande Sande & Priddy

[57] ABSTRACT

A substantially closed nursing mug having an upper discharge nipple (31) and a vertically extending dosing chamber (18) adjacent to a side wall portion (3a) of the mug, the volume of the dosing chamber corresponding to a predetermined liquid volume to be drunk at a time. Upper and lower valves (11, 12) are disposed at the upper and lower ends, respectively, of the dosing chamber (18). The upper valve (11) is adapted to automatically switch from a closing position to an opening position when the mug is tilted beyond a first tilting angle, and the lower valve (12) is adapted to automatically switch from an opening position to a closing position when the mug is tilted beyond a second tilting angle being less than or substantially equal to the first tilting angle.

11 Claims, 2 Drawing Sheets

MUG WITH INSERT FOR DISPENSING MEASURED QUANTITY

FIELD OF THE INVENTION

The present invention relates to a substantially closed nursing mug of the kind comprising an upper discharge nipple, a liquid flow channel extending from the bottom portion of the mug to said upper discharge nipple, and valve means disposed in said liquid flow channel for controlling the discharge liquid flow.

BACKGROUND OF THE INVENTION

Such nursing mugs or bottles are known, e.g., from US-A-2 877 917 and US-A-3 044 650. In these known devices, which are intended for the feeding of small babies, the liquid flow channel and the valve means disposed therein serve the purpose of preventing the infant from sucking air while being fed with milk from the bottle.

SUMMARY OF THE INVENTION

The main object of the present invention, on the other hand, is to facilitate the feeding of drinking liquids to elderly patients, who have difficulty in drinking from ordinary drinking glasses. Many of such patients must be fed by another person, e.g., a nurse. Even so, the patient cannot always control the drinking and swallowing of the liquid properly, and as a result, too much liquid is often poured into the patient's mouth and, consequently, frequently spills out.

According to the invention, this problem is solved by way of a nursing mug, in which the liquid flow channel is located adjacent to a side wall portion of the mug and includes a dosing chamber, the volume of which corresponds to a predetermined liquid volume to be drunk at a time, wherein the valve means includes upper and lower valves at the upper and lower ends, respectively, of the dosing chamber, said upper valve being adapted to automatically switch from a closing position to an opening position when the mug is tilted past a first tilting angle, and said lower valve being adapted to automatically switch from an opening position to a closing position when the mug is tilted past a second tilting angle, which is less than or substantially equal to the first tilting angle. Thus, when the mug is tilted, a proper dosage of drinking liquid will automatically enter into the dosing chamber, whereupon this dosage can easily be drunk by the patient without any risk of receiving too much drinking liquid into the mouth. In principle, such a mug can be used also by young or healthy persons who have difficulties in swallowing properly, although they are otherwise capable of holding and tilting the mug with their own hands.

BRIEF DESCRIPTION OF THE DRAWINGS

Further features of the mug according to the invention will appear from the appended claims and from the following detailed description of a preferred embodiment, reference being made to the accompanying drawings.

DESCRIPTION OF PREFERRED EMBODIMENT

Figure 1:
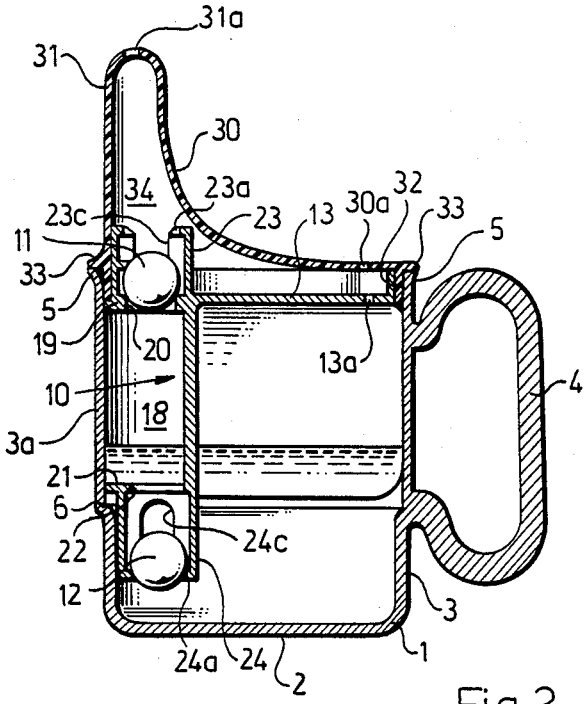
FIG. 1 shows a central longitudinal section through a nursing mug in upright position.
Figure 3:
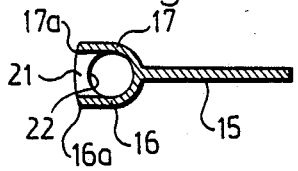
FIG. 3 is a transversal section along line III—III in FIG. 2.
Figure 2:
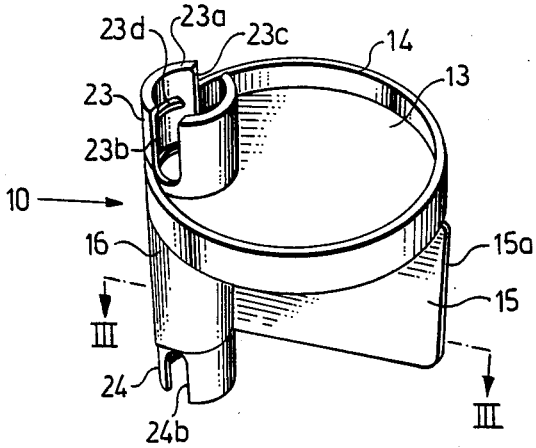
FIG. 2 shows a perspective view of an insert body forming a part of the nursing mug of FIG. 1.

The nursing mug shown in FIG. 1 comprises essentially three parts, i.e. a mug 1 having a bottom wall 2, and a substantially cylindrical side wall 3 and a handle 4, an insert body 10 (see FIG. 2) with upper and lower valves 11 and 12, respectively, and an upper closure member 30 of resilient material partially forming a discharge nipple 31.

The mug part 1 and the insert body 10 are preferably produced by injection molding in one piece, respectively, of a thermal plastic material, such as polycarbonate, which is resistant to washing in a dish washing machine, whereas the upper closure member 30 is made of a relatively flexible plastic material or a thermo-plastic rubber material, such as TPG.

The mug part 1 is substantially cylindrical with an upper end opening defined by an upper circular edge 5 flaring slightly outwardly and an annular shoulder 6 providing an abutment for the insert body 10.

The insert body 10 comprises a lid portion 13 having a circumferential, upright flange 14 dimensioned to fit inside the upper edge 5 of the mug 1 at a small distance therefrom. Below the lid portion 13, the insert body 10 is provided with a holding plate 15, which in inserted postion will be oriented in a longitudinal, central plane of the mug and reach down substantially to the shoulder 6. The outer edge 15*a* of the holding plate 15 will bear against the inside surface of the cylindrical wall 3 of the mug and thereby hold the insert body in the inserted position shown in FIG. 1. At the side opposite to the edge 15*a* of the holding plate 15, the insert body has vertically extending wall portions 16, 17, the free edges 16*a*, 17*a* of which are dimensioned to sealingly contact the inside of the corresponding wall portion 3*a* of the mug 1 so as to define a vertically extending dosing chamber 18 (FIG. 1). The dosing chamber 18 is closed at the top by a top wall 19 having an opening defining an upper valve seat 20 and at the bottom by a lower wall 21 having an opening defining a lower valve seat 22. The insert body 10 is furthermore provided with upper and lower tubular portions 23 and 24, respectively, which extend longitudinally in line with the vertical axis of the dosing chamber 18. These tubular portions 23, 24 serve as valve casings for the respective valves 11, 12 which are constituted by balls of a heavy material, such as steel. The valve balls 11,12 are movable between the respective valve seat 20,22 and a stop flange 23*a* and 24*a*, respectively. Each tubular portion 23, 24 is also provided with opposite longitudinal slots 23*b*, 23*c* and 24*b*, 24*c*, respectively, permitting fluid flow in all positions of the balls except when the latter are seated against the respective valve seats 20,22. The valve balls 11,12 are dimensioned to fit loosely in the respective casing or tubular portion 23,24, and the position of each ball will be determined by the forces effected by gravity and the fluid pressure. Additionally, in the tubular portion 23, an inside threshold rim 23*d* extends partially in the circumferential direction between the slots 23*b* and 23*c* on the side adjacent to the circumferential flange 14 of the insert body 10. Hereby, when the mug is tilted (see FIGS. 4*a–d*), the valve ball 11 must to be lifted somewhat over the threshold rim 23*d* before it can leave the seated, closing position shown in FIG. 1.

The upper resilient closure member 30 has a downwardly directed flange 32, to be fitted between the upper flange 14 of the insert body 10 and the upper edge portion 5 of the mug 1, and an outwardly projecting flange 33, which will rest on top of the upper edge 5 of the mug 1, as shown in FIG. 1. As appears from FIG. 1, the closure member 30 and the lid portion 13 of the insert body 10 are provided with vent holes 30*a* and 13*a*, respectively, in the region diametrically opposite to the upper valve 11. At the top of the nipple portion 31 of the closure member 30, there is at least one discharge opening 31*a*. When the three parts 1, 10 and 30 are assembled as shown in FIG. 1, an upper feeding chamber 34 is formed between the lid portion 13 and the closure member 30.

The steel valve balls 11, 12 can be snapped into the respective, somewhat resilient tubular portions 23 and 24 of the insert body 10. After filling the mug 1 with a drinking liquid, such as a beverage or a soup, the insert body 10 and the upper closure member 30 are fitted into the positions shown in FIG. 1. The lower valve 12 is now positioned at the bottom part of the mug 1 opposite to the handle 4, whereas the upper valve 11 is located at a level corresponding to the upper edge 5 of the mug 1.

Figure 4A:
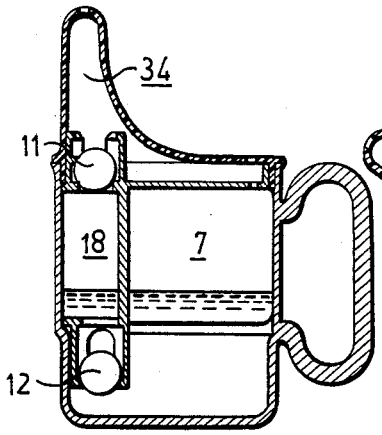
FIGS. 4*a–d* are central longitudinal sections through the mug according to FIG. 1, illustrating the function thereof while being tilted successively to increasing tilting angles.
Figure 4B:
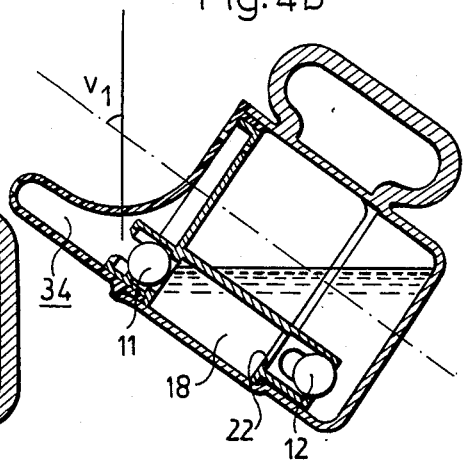
Figure 4C:
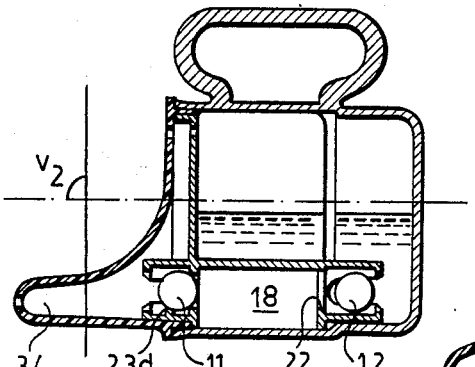

The normal use of the mug is illustrated in FIGS. 4*a*, 4*b*, 4*c* and 4*d*. Thus, in the upright position shown in FIG. 4*a*, the liquid has the same level in the interior 7 of the mug as in the dosing chamber 18, since the lower valve ball 12 occupies a lower, opening position because of the gravitational force acting thereon. When the mug is tilted at an angle $v_1$ towards the side with the dosing chamber 18, as shown in FIG. 4*b*, the dosing chamber 18 will be filled with liquid through the lower valve opening 22. The upper valve ball 11, on the other hand, remains closed, since the fluid pressure acting thereupon is not sufficient to lift the valve ball 11 over the threshold rim 23*d*.

When the mug is tilted to a predetermined tilting angle $v_2$, in the present example about 90° relative to the vertical direction, the lower valve ball 12 will move from its opening position to its closing position against the valve seat 22 by the influence of the fluid pressure. Of course, the angle $v_2$, at which the valve 12 switches from the opening position to the closed position, will be dependent on the amount of liquid remaining in the mug. Thus, the angle $v_2$ will be less than 90° when the mug liquid level is high.

Figure 4D:
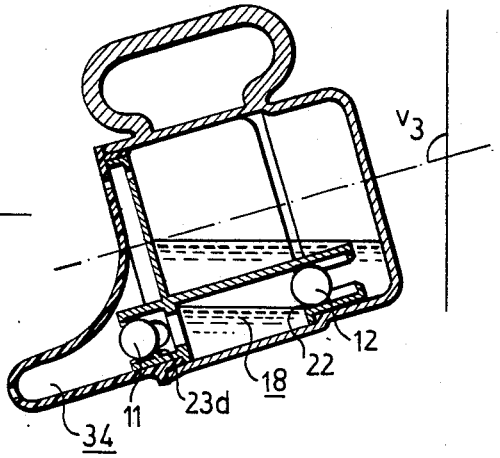

It will be a apparent that the fluid pressure on the valve ball 12 is always greater than or equal to the fluid pressure acting on the valve ball 11 (for tilting angles up to 90°), and because of the threshold rim 23*d* this means that the lower valve ball 12 will switch into a closing position before the upper valve ball 11 opens. Upon tilting the mug further, in the illustrated example to an angle $v_3$ greater than 90°, as shown in FIG. 4*d*, the upper valve ball 11 will roll over the threshold rim 23*d*, so that an amount of liquid corresponding to the volume of the dosing chamber 18 flows into the feeding chamber 34 and can be drunk by the patient.

As will be apparent from the above description, the patient will thus receive a predetermined, limited amount of liquid each time the mug is tilted to pour out the liquid contents thereof, whereby the liquid dosage can easily be swallowed by the patient. Also, the risk of spilling out the liquid is greatly reduced.

As mentioned above, relatively healthy patients can handle the mug without any help from a nurse. In such cases, the handle 4 can be located at a position angularly offset about 90° from the position shown in FIG. 1. Alternatively, the handle 4 may be totally omitted.

Of course, the tilting angles $v_2$ and $v_3$, at which the respective valves will switch positions, may vary as long as the tilting angle $v_2$ is less than or substantially equal to the tilting angle $v_3$. As stated above, these tilting angles will also vary somewhat with the amount of liquid in the mug. Moreover, the structural features and the materials used for the various parts may be modified by those skilled in the art within the scope of the appended claims. For example, the closure member 30 may be replaced by a nipple connected to the tubular portion serving as a casing for the upper valve.

We claim:

1. A substantially closed nursing mug having an upper end opening, said mug being of the kind comprising an upper discharge nipple (31), a liquid flow channel (18) extending from the bottom portion of the mug to said upper discharge nipple, and valve means (11, 12) disposed in said liquid flow channel for controlling the discharge liquid flow, wherein said liquid flow channel is located adjacent to a side wall portion (3*a*) of said mug and includes an elongated dosing chamber (18) extending along more than one-half of a longitudinal dimension of said side wall portion and being located on a same side of said mug as said upper discharge nipple, the volume of said dosing chamber corresponding to a predetermined liquid volume to be drunk at a time, wherein said valve means includes upper and lower valves (11, 12) at upper and lower ends, respectively, of said dosing chamber (18), said upper valve (11) being closed and said lower valve (12) being open when the mug is in upright position, said lower valve (12) is adapted to automatically switch to a closing position when the mug is tilted beyond a first tilting angle $v_2$, and said upper valve (11) is adapted to automatically switch to an opening position when the mug is tilted beyond a second tilting angle ($v_3$) at least substantially equal to said first tilting angle (v2).

2. A nursing mug as in claim 1, wherein said first tilting angle ($v_2$) is about 90°, and said second tilting angle ($v_3$) is about 90° or slightly greater.

3. A nursing mug as claimed in claimed in claim 1, wherein said valves are constituted by upper and lower valve balls (11, 12) cooperating with valve seats (20, 22) at said upper and lower ends of said dosing chambers (18).

4. A nursing mug as claimed in claim 3, wherein said valve balls are made of steel.

5. A nursing mug as claimed in claim 1, wherein said upper and lower valves (11, 12) cooperate with valve seats (20, 22) disposed in a unitary insert body (10) also including a chamber wall (16, 17) which at least partly confines said dosing chamber (18).

6. A nursing mug as claimed in claim 5, wherein said insert body (10) includes upper and lower tubular portions (23, 24), in which said upper and lower valves (11, 12) are movable between the respective valve seats (20, 22) and upper and lower opening positions, respectively.

7. A nursing mug as claimed in claim 6, wherein said upper tubular portion (23) includes a threshold member (23*d*) contributing to hold said upper valve (11) in a closing position at tilting angles smaller than said second tilting angle ($v_3$).

8. A nursing mug as claimed in claim 5, wherein said unitary insert body (10) also includes an upper lid portion (13) fitting into the upper end opening of the mug (1) and in that said upper valve seat (20) is located in said lid portion.

9. A nursing mug as claimed in claim 5, wherein said unitary insert body (10) also includes a holding portion (15) adapted to hold said chamber wall (16, 17) adjacent to said side wall portion (3*a*) of the mug (1).

10. A nursing mug as claimed in claim 1, wherein said upper discharge nipple (31) forms a part of an upper closure member (30) of a resilient material and in that an upper feeding chamber (34) is formed between said closure member (30) and a rigid lid member (13) at the upper end opening (5) of the mug (1), wherein said upper feeding chamber (34) communicates with said dosing chamber (18) via said upper valve (11, 20).

11. A nursing mug as claimed in claim 1, wherein said upper discharge nipple (31) is constituted by a suction nipple.

* * * * *